United States Patent [19]

Allyn et al.

[11] 4,050,502

[45] Sept. 27, 1977

[54] METHOD FOR CONTINUOUSLY CASTING A STRIP OF ALLOYED METAL

[75] Inventors: Jerome B. Allyn, Graytown; Richard D. Wileman; John Kozak, both of Toledo, all of Ohio

[73] Assignee: Midland-Ross Corporation, Cleveland, Ohio

[21] Appl. No.: 713,170

[22] Filed: Aug. 10, 1976

Related U.S. Application Data

[62] Division of Ser. No. 536,485, Dec. 26, 1974, Pat. No. 4,010,939.

[51] Int. Cl.[2] ..... B22D 11/10; F27B 9/04

[52] U.S. Cl. ..... 164/68; 164/82; 164/133; 164/335; 266/207; 266/236; 266/266

[58] Field of Search ..... 164/68, 82, 87, 133, 164/335, 337, DIG. 1; 266/207, 236, 266

[56] References Cited

U.S. PATENT DOCUMENTS

| | | | |
|---|---|---|---|
| 1,866,682 | 7/1932 | Temmen | 164/133 |
| 2,054,921 | 9/1936 | Betterton | 164/337 UX |
| 2,271,168 | 1/1942 | Booth | 266/236 X |
| 2,660,769 | 12/1953 | Bennett | 164/337 X |
| 3,116,998 | 1/1964 | Pagonis | 266/207 X |
| 3,467,167 | 9/1969 | Mohin | 266/207 X |
| 3,991,263 | 11/1976 | Folgero et al. | 164/335 X |

*Primary Examiner*—Ronald J. Shore
*Attorney, Agent, or Firm*—Frank J. Nawalanic

[57] ABSTRACT

An arrangement is provided for feeding a liquid alloyed metal under protective atmosphere into a high speed continuous casting machine for casting a strip of alloyed metal, preferably calcium lead which is subsequently formed into battery grids and the like. The arrangement includes atmosphere tight holding and melting pots constructed of steel plates with submerged electrical heating elements, a level control arrangement for the liquid baths therein and a skid ramp in the melting pot for charging metal hogs therein.

1 Claim, 4 Drawing Figures

METHOD FOR CONTINUOUSLY CASTING A STRIP OF ALLOYED METAL

This is a division of application Ser. No. 536,485, filed Dec. 20, 1977, now U.S. Pat. No. 4,010,939.

This invention relates generally to an arrangement for feeding a liquid alloyed metal under atmosphere protection into a high speed continuous strip casting machine and, more particularly, to the construction and operation of certain parts in the arrangement.

The invention is particularly applicable to an arrangement for liquifying and feeding in liquid form calcium lead into a high speed continuous strip casting machine which in turn produces a continuous solid strip of calcium lead which is subsequently formed into battery grids and the like. It will be appreciated by those skilled in the art that the invention may have broader applications and may be used as a liquid feed arrangement for other metals which are to be cast or solidified in high speed operations.

In conventional cast lead battery plates, antimony (Sb) is used to control strength and shrinkage. However, the presence of antimony results in gassing or hydrogen liberation. Gassing results in water loss and corrosion of the battery terminals and requires periodic addition of water to the battery which in turn necessitates placement of the battery in the vehicle in a convenient accessible spot. Battery plates cannot be formed of high purity lead since lead does not have the strength and hardness to withstand the combination of creep and vibration in typical battery applications. It cannot resist the stresses that occur in a conventional grid molding machine during the mold release process. It cannot be formed into grinds from continuously cast strip since it does not have the strength and hardness to successfully withstand deformation during blanking, punching, expanding, etc., operations. Accordingly, alternative hardening elements have been investigated and, in particular, battery plates have recently been cast by the addition of calcium as a hardener in the lead.

Calcium is soluble in lead at the melting point of lead and after solidification of the lead, the calcium forms a precipitation hardening phase developed by cold work and time. It is believed that the precipitation of calcium lead components at the grain boundaries may be suspect of preferential attack by the acid to weaken the battery grid structure. It is thus believed essential that the calcium lead phase be uniformly and finely disbursed in the original cast material to prevent breakdown of the grid. It is furthermore believed that such distribution occurs when a high speed casting machine is employed in the process because the cooling rate of the liquid solution is significantly increased thus insuring a uniform solid phase distribution of the calcium within the lead with a minimum loss of calcium resulting from oxidation. For the casting machine to properly function in such a manner, it is essential that a homogeneous calcium lead liquid solution, accurately controlled in flow rate and temperature, be fed into the casting machine in an extremely stabilized manner by apparatus positioned upstream of the caster.

Calcium is a very active metal and oxidizes rapidly, especially when in a pure or alloyed form. Lead oxidizes far less rapidly under similar conditions. Molten calcium lead will therefore lose calcium due to oxidation when in the presence of air and the percentage of calcium in the alloy will quickly diminish unless replenished. The calcium level will not diminish, however, when properly protected by an inert atmosphere such as nitrogen or argon. In order for calcium lead strip to be successfully and economically formed into battery grids, it is essential that the calcium level remain at the specified point without calcium additions. Replenishment during the course of melting and transfer is economically unacceptable. It is therefore essential that the calcium lead liquid solution be protected at all points during the melting, holding, transfer, and casting process.

Accordingly, it is an object of the invention to provide efficient and economic apparatus upstream of a relatively fast continuous casting machine which distributes to the caster in a stable manner a homogeneous alloyed metal mixture, completely protected under inert atmosphere from the melting point to the casting point.

This object along with other features of the subject invention is achieved principally by the use of an atmosphere tight melting pot upstream of an atmosphere tight holding pot which in turn feeds liquid calcium lead into the caster arrangement. Independent float arrangements controlling the liquid calcium lead bath level permit the holding pot to operate effectively as a surge tank. A flow switch arrangement inserted in the protective atmosphere inlet line in both pots prevents the calcium lead bath levels from overflowing.

Heating of the baths is uniformly and efficiently achieved by a plurality of electrical heating conductors inserted in straight length protection tubes entirely submersed within the baths; the arrangement facilitating replacement of defective heating units and proper heat transfer at all times. Charging of the melting pot is uniquely accomplished by an inclined, curvilinear ramp which utilizes friction and the molten metal in the melting pot to dissipate the gravitational kinetic energy of the lead hog as same slides down the ramp into the bath while also supporting the hog at a fixed position within the bath to insure homogeneous mixing of the calcium and lead while the hog melts.

A still further aspect of the invention centers about the construction of the melting and holding pots. Both pots are, in essence, enclosures defined by a peripherally extending metal plate sidewall, preferably rectangular. The sidewall has an upper flanged end which sealingly receives a top cover and a flat bottom end which is welded to a bottom plate to define the enclosure. Appropriate superstructure secured to the bottom plate suspends each enclosure at its proper attitude in the battery line. Fibrous insulation is impaled on rods attached to the exterior of the sidewall and bottom plate section and protected by thin panels secured to the plates. Heretofore, all melting pot arrangements utilized ladles or crucibles positioned in pits which in turn were fitted with permanent insulation and support structure integrated in a relatively expensive assembly.

It is thus another object of the subject invention to provide efficient and economic apparatus suitable for holding and conveying metal and preferably alloyed metal in a liquid state.

The invention may take physical form in certain parts and arrangement of parts, a preferred embodiment of which will be described in detail herein and illustrated in the accompanying drawings which form a part hereof and wherein.

Figure 1:
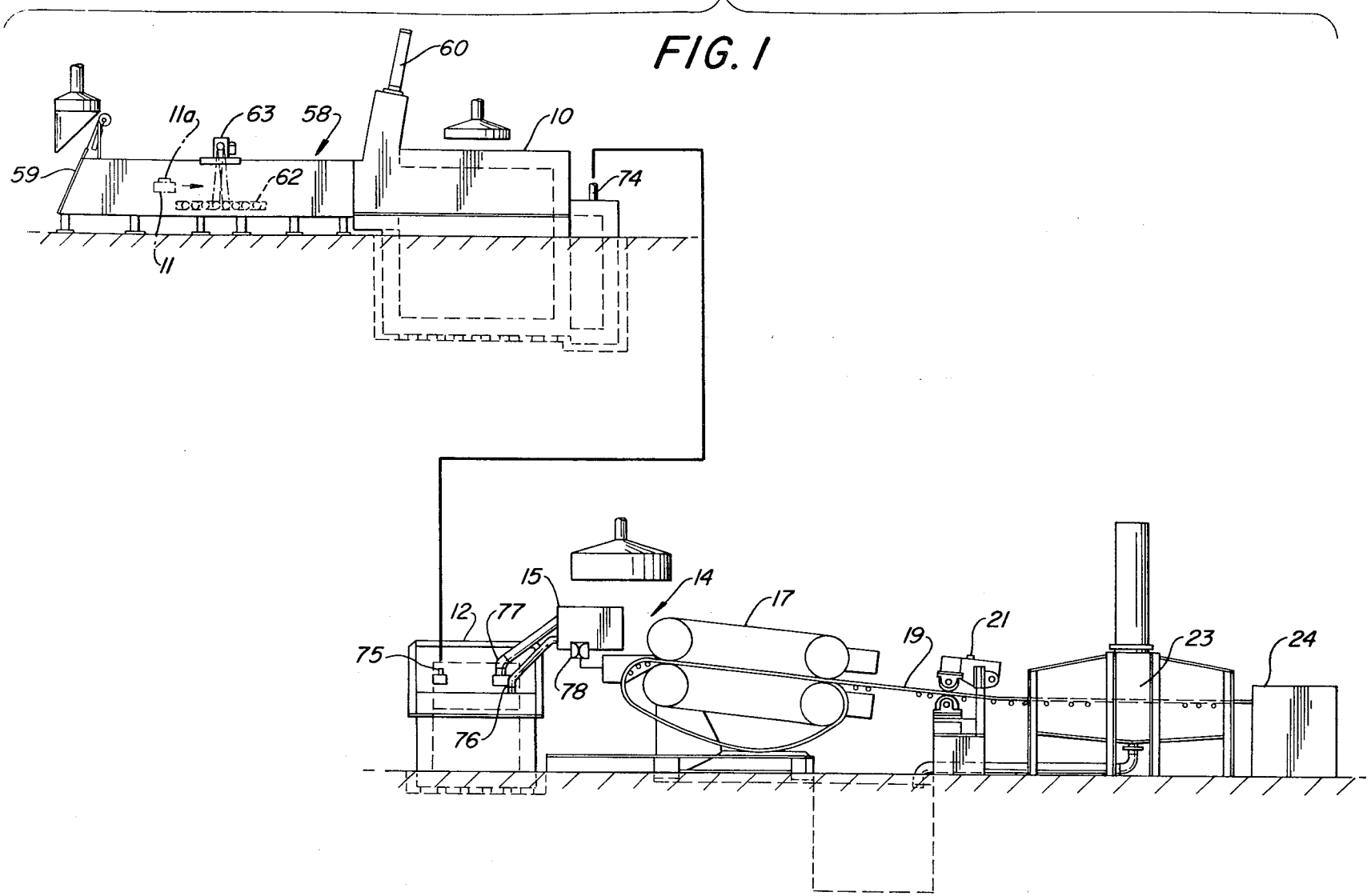
FIG. 1 is a schematic view of the battery grid assembly line and specifically the portion of the line illustrating the casting of a continuous strip of calcium lead.

Referring now to the drawings wherein the showings are for the purpose of illustrating a preferred embodiment of the invention only and not for the purpose of limiting same, there is shown in FIG. 1 an arrangement for casting calcium lead into strip which includes a melting pot 10 for liquifying lead hogs 11 with calcium-lead ingots 11*a* (for alloying) placed on top thereof, a holding pot 12 into which liquid calcium lead from melting pot 10 is pumped and a caster arrangement 14. Caster arrangement 14 includes the conventional atmosphere protected holding box 15 which meters liquid calcium lead into an atmosphere protected tundish 16 which in turn feeds liquid calcium lead into a continuous casting machine 17. Casting machine 17 casts a continuous strip of calcium lead 19 which then passes through a conventional pinch roll 21 controlling the line speed downstream thereof and thence into a secondary cooling chamber 23 employing conventional water spray arrangements to cool the strip after which it is processed into conventional battery grid formations as indicated diagrammatically at 24.

Figures 2, 2A:
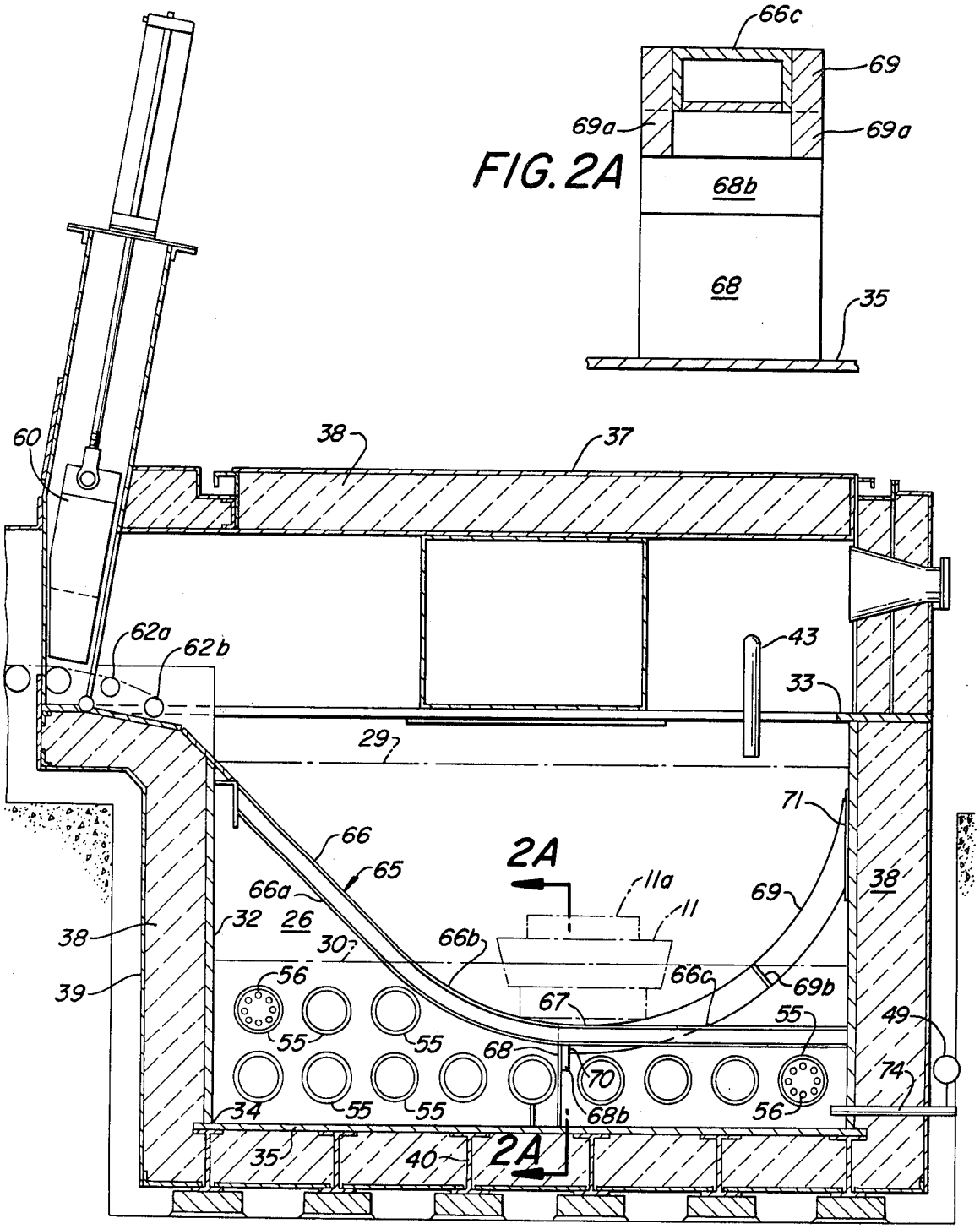
FIG. 2 is a sectioned elevation view of the melting pot of the subject invention.
FIG. 2A is a further sectioned view of a portion of the melting pot taken along line 2A—2A of FIG. 2.
Figure 3:
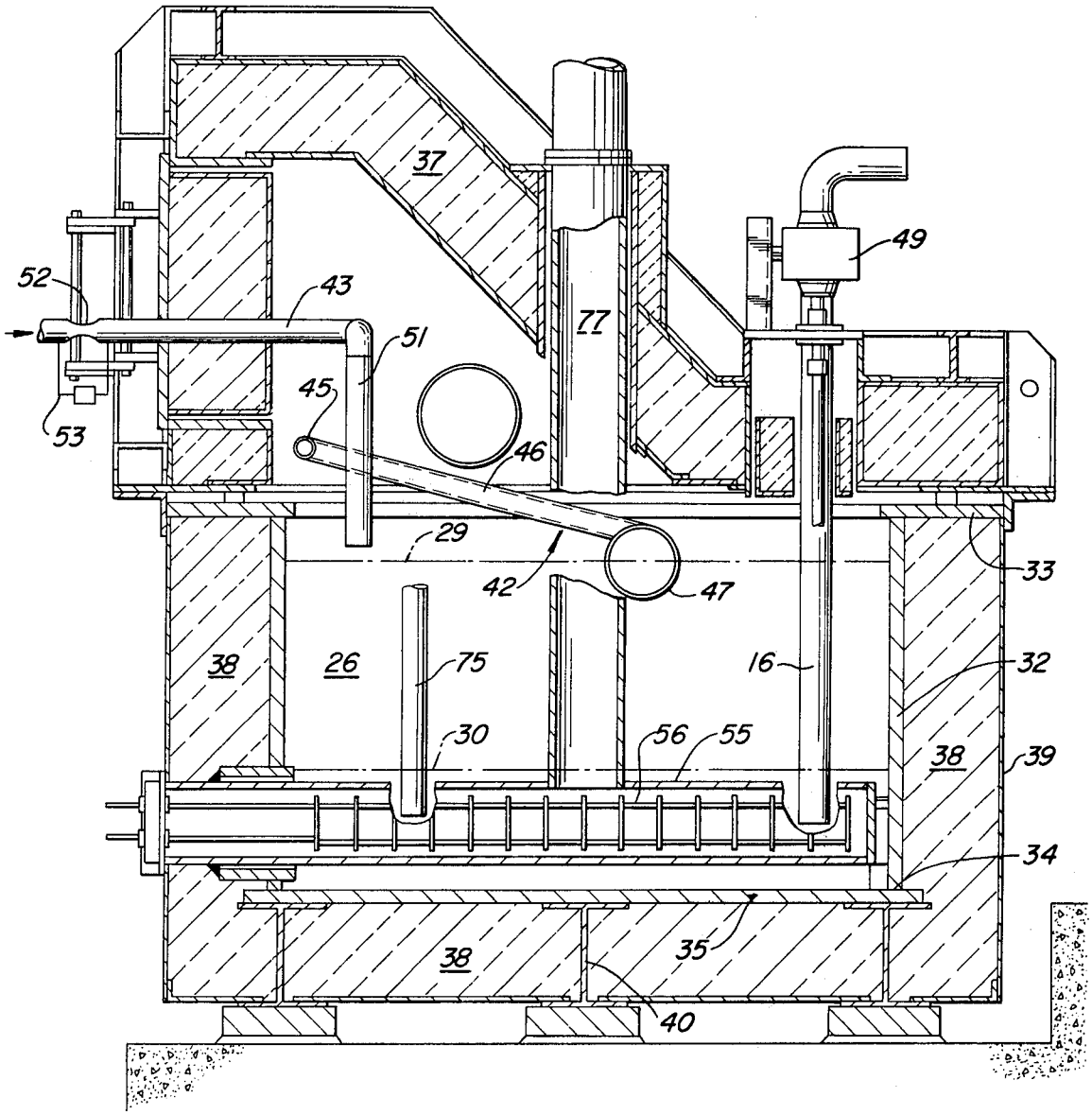
FIG. 3 is a sectioned elevation view of the holding pot of the subject invention.

It should be noted that melting and holding pots, as shown in FIGS. 2 and 3 respectively, employ similar constructions and like numbers will be used to designate like parts where applicable. Generally, both pots 10, 12 may be defined as insulated enclosures 26 for containing liquid baths of calcium lead between upper and lower, or maximum and minimum, bath levels 29, 30 respectively. More particularly, insulated enclosure 26 is defined by a continuous plate sidewall 32 peripherally extending or circumscribing a predetermined boundary. In the preferred embodiment, plate sidewall 32 in fact comprises four individual plates welded at their ends into a rectangular configuration. Sidewall 32 of each pot has an upper flanged end 33 and a lower flat end 34 to which is welded a bottom plate 35. Alternatively, lower end 34 could be flanged. Sealingly secured to upper flanged end 33 is an appropriate top cover insulated structure 37 resulting in enclosure 26 being airtight. Enclosure 26 is insulated by conventional fibrous insulation 38 disposed about the exterior of sidewall 32 and bottom plate 35 and held in place by being impaled on rods thereagainst and protected by relatively thin or sheet metal type panels 39 in turn suitably secured to the sidewall and bottom plate. Both pots 10, 12 are maintained at proper elevation in the assembly line by appropriate superstructure supports 40 secured to bottom plate 35.

Both melting and holding pots 10, 12 employ identical bath control arrangements controlling the levels of the liquid calcium lead therein. The level controls include primarily a float arrangement 42, which for drawing clarity is shown only in FIG. 3 and a failsafe control 43 which prevents the bath level from overflowing the enclosure. As shown in FIG. 3, float arrangement 42 includes a rotatable shaft 45 suspended in top cover 37. A lever arm 46 has one end secrued to rotatable shaft 45 and its other end secured to a float 47 which is in contact with the calcium lead bath. When the bath level rises or falls, shaft 45 rotates and contacts conventional limit switches (not shown) which in turn actuate a pump 49 in the holding pot, or advises the operator to stop charging, or to recharge the melting pot 10. More particularly, if the bath level in holding pot 12 reached its minimum level 30, pump 49 in melting pot 10 would be actuated to pump lead into holding pot 12 and when the maximum bath level 29 was reached in holding pot 12, pump 49 in melting pot 10 would be shut off. With respect to the bath level in melting pot 10, the actuation of the limit switch at minimum bath level 30 would stop the melting pot pump and would signal the operator to charge the melting pot. Actuation of the limit switch at maximum bath level 29 would signal the operator to stop charging the melting pot.

Failsafe control arrangement 43 includes a protective atmosphere pipe 51 which extends through top cover 37 into enclosure 26 and is spaced a predetermined distance from bottom plate 35. Specifically, the opened end of pipe 51 is preferably set a slight distance, nominally one inch, above the upper or maximum lead bath level 29. Injected into pipe 51 is a continuous stream of gas which produces a protective atmosphere within enclosure 26; the gas being continuously withdrawn through a suitable outlet in the enclosure (not shown). The protective atmosphere gas is one which is substantially devoid of oxygen to prevent oxidation of the liquid calcium lead and preferably is nitrogen or argon. Positioned within pipe 51 is a fixed orifice 52 and pressure taps 53 upstream and downstream of orifice 52 sense a drop in gas pressure flow through the pipe to actuate a signal. A decrease in the pressure drop through orifice 52 obviously occurs in the event that float arrangement 42 fails and the upper or maximum bath level is exceeded and the like is blocked by the bath.

A plurality of straight protection tubes 55 spaced closely adjacent to bottom plate 35 and positioned below minimum bath level 30 in both melting and holding pots 10, 12 extend into enclosure 26 through openings in one sidewall 32 in equally spaced increments. Tubes 55 are of conventional heavy wall construction having a wall thickness of approximately 1/2 inch, and are closed at the inner end. Disposed within each tube is an electrical resistance type heating element 56. Since heating elements 56 are disposed entirely within the calcium lead bath, the efficiency of the heating arrangement is improved over the prior art while the straightness of tubes 55 facilitates easy removal of the heating element in the event of failure.

Referring now to FIG. 1, melting pot 10 is equipped with a conventional vestibule arrangement 58 having a conventional power driven inlet door 59 and an outlet door 60; the outlet door providing entry into melting pot 10 and also shown in FIG. 2. Vestibule 58 is provided with purge gas that originates from melting pot atmosphere pipe 51. The gas flows past door 60, which has a certain amount of leakage, and effects a protective atmosphere within the vestibule after inlet door 59 is open to receive lead hog 11 prior to opening outlet door 60. Lead hog 11 is conveyed through the vestibule into the melting pot through a charging mechanism shown as rollers 62 chain driven in a conveyor-like manner by a motor 63. There is a flag switch at the end of driven conveyor 62, just outside door 60, that senses the presence of a lead hog. This switch, in combination with a timer, and the conveyor drive 63, allows the charging of just one hog at a time. A discrete time interval must elapse before another hog can be charged, to allow the previous hog to melt completely. It should be noted that rollers 62 extend into melting pot 10. Specifically, rollers designated as 62*a*, 62*b*, downstream of outlet door 60, are free rolling, smaller in diameter than those upstream of outlet door 60 and vertically staggered with respect to one another to provide a vertical offset for dropping lead hogs 11 into enclosure 26.

Referring now to FIGS. 2 and 2A, continuous with staggered rollers 62*a*, 62*b* is a ramp or hog slide arrangement 65 which is essentially disposed within insulated enclosure 26 of melting pot 10. Ramp 65 is continuous, has a constant curvature within the curvilinear portion, and comprises a plurality of transversely-spaced runners 66 having a straight portion 66*a* adjacent staggered rollers 62*a*, 62*b* extending downwardly into the bath at an angle thereto. At the intersection of straight portion 66*a* with the minimum bath level 30, each runner 66 assumes a curvilinear shape over an intermediate portion 66*b* thereof, which curvilinear shape continues until runner 66 reaches the approximate midsection or midpoint 67 of enclosure 26. At midpoint 67, ramp arrangement 65 is closest to bottom plate 35 and struts 68 extending upwardly from bottom plate 35 are provided to hold or brace ramp arrangement 65 at the approximate midpoint 67. A cross piece 68*b* is welded or fastened to struts 68*a* to provide a continous support structure. The continuous runners 66 then extend from the end of intermediate curvilinear portions 66*b* in a linear, straight line portion 66*c* where they terminate at or are welded to sidewall 32.

Each runner 66 at the end of its intermediate section 66*b* is sandwiched between or embraced by a pair of curvilinear side runners 69. As best shown in FIG. 2A, each pair of curvilinear side runners 69 includes parallel and aligned curvilinear side plates 69*a* extending from each side of runner 66 with at least one strap 69*b* joining side plates 69*a* together at their midpoint. The top surfaces of side plates 69*a* are aligned with the base of runners 66 at midpoint 67 of enclosure 26. Curvilinear side runner pairs 69 have a leading end 70 supported by cross piece 68*b* in aligned relationship with the trailing end of intermediate runner portions 66*b*. Leading ends are not fastened to cross piece 68*b* but only rest on it. Each curvilinear side runner pair 69 also has a trailing end 71 secured to sidewall 32 as shown. It should be noted that both intermediate portion 66*b* of runner 66 and curvilinear side plates 69*a* have the same degree of curvature and both may be defined as identical arcuate segments having the same radius. It should also be noted that the center support arrangement 68 permits some degree of flexibility in curvilinear runner 69 which prevents damage to ramp arrangement 65. That is, lead hog 11 will be charged into the liquid calcium lead bath by gravity. As it slides down inclined runner portion 66*a*, the kinetic energy will be partially dissipated when the hog enters the bath. As the lead dog travels up the curvilinear runner 69, gravity is utilized to arrest its motion. However, large damaging stresses can arise in runners 69 due to the centrifugal force that arises from turning the rapidly moving hog along a constant curvature. Since the leading ends 70 of runners 69 are not fastened to support structure 68, runners can flex and move slightly due to the centrifugal force, permitting the motion of the lead hog to be arrested without damage to the ramp structure.

In operation and assuming that calcium lead liquid bath levels have been established in the melting and holding pots, float arrangement 42 in melting pot 10 would indicate to the operator that when the minimum bath level 30 is reached in the melting pot, a lead hog can be charged into the melting pot via the conveyor roller drive arrangement 62 in vestibule 58. Lead hog 11 placed in the vestibule is generally about 2,000 pounds in weight and calcium lead alloying ingots 11*a* approximately 50 pounds in weight are set on top of the lead hogs. Actuation of the roller conveyor mechanisms 62 will open vestibule outlet doors 60 and lead hog 11 and ingots 11*a* will be conveyed into the bath of the melting pot by ramp arrangement 65 as previously described. Electric heating elements 56 will generate sufficient heat to melt lead hog 11 into the bath which is maintained at a temperature of approximately 700°–750° F. It is contemplated that the thermal convection resulting from the heat released from protection tubes 55 will be sufficient to establish a homogeneous mixture between calcium lead ingot 11*a* and lead hog 11 after the same has been melted. Importantly, ramp arrangement 65 maintains lead hog 11 at a predetermined height within the bath which assists in the uniformity of the bath mixture as the hog melts down. It is also contemplated that the operator will assist in controlling calcium lead bath level so that lead will not be withdrawn from melting pot 10 until a homogenous mixture has occurred.

Discharge of calcium lead from melting pot 10 into holding pot 12, which is likewise maintained at a temperature of approximately 700°–750° F., is controlled by float arrangement 42 in holding pot 12. That is, when lower bath level 30 is reached in the holding pot, pump 49 in melting pot 10 will be actuated to pump liquid calcium lead from the melting pot outlet 74 through the holding pot inlet 75. When upper maximum bath level 29 is sensed in the holding pot, melting pot pump 49 will be disengaged. Charging of hogs into the melting pot is governed by the float arrangement 42 in the melting pot 10. If the melting pot level is below maximum level 29, the operator is free to initiate a charge cycle for a hog. If the level is at maximum level 29, the float 42 will initiate a signal to advise the operator to stop charging hogs. If the operator continues to charge the melting pot, failsafe control 43 in the melting pot will prevent further actuation of roller drive means 62 and, if necessary, a drain-off of excess calcium lead may be effected in the line between melting pot outlet 74 and holding pot inlet 75.

Pump 49 in holding pot 12 is in continuous operation constantly pumping liquid calcium lead from holding pot outlet 76 into the inlet of holding box 15 and back through a closed loop recirculation into the closed loop inlet 77 of holding pot 12. The closed loop recirculation in holding box 15 is established to maintain a fixed liquid bath head within the holding box so that metering of calcium lead from holding box 15 into tundish 16 through an orifice 78 occurs at a constant rate. In the event that failsafe control 43 in the holding box is actuated, calcium lead can be tapped from the holding pot using the closed loop piping.

From tundish 16 the calcium lead is injected uniformly into continuous casting machines 17 where it solidifies into a continuous strip of lead 19 as it leaves the caster.

Continuous cast calcium lead strip 19 leaving caster 17 is then passed through pinch roll 21 running at a speed slightly less than that of the caster to maintain the cast strip in slight compression to prevent tearing. The strip is next passed into secondary cooling chamber 23 which employs a conventional water spray nozzle arrangement to cool the strip to a workable temperature of approximately 100° F. The strip then leaves secondary cooling arrangement 23 into conventional forming processes shown diagrammatically at 24.

The casting machine 17 shown in known in the trade as the "Hazelett Strip Casting Machine" and is described in several U.S. patents including U.S. Pat. Nos. 2,904,860 and 3,167,830. The Hazellett caster is characterized primarily by its high speed of operation and its ability to cast thin sections. In the embodiment shown, caster 17 will operate to cast 20 tons of lead per hour at a width of ten inches and a thickness of less than one inch, although it is contemplated that the smallest Hazelett casting machine used for casting calcium lead will produce 8 tons of cast calcium lead per hour. In contrast, other continuous strip casting machines known in the art will operate at best at only 1/5 to 1/10 times the speed of the Hazelett caster and the largest type of such casting machines will produce, at best, 6 tons of cast calcium lead strip per hour. Since the volume of calcium lead cast is considerable, and because it is critical to feed liquid calcium lead at proper temperature in a homogeneous solution into the caster to achieve desired grain characteristics in the cast strip, it is believed that the float arrangement and controls shown are critical to the successful operation of the caster, especially so when it is realized that the temperature in the melting pot can decrease 20° F. upon the charge of one single lead hog therein.

The invention has been described with reference to a preferred embodiment. Obviously, modifications and alterations will occur to others upon reading and understanding the specification. It is out intention to include all such modifications and alterations insofar as they come within the scope of the invention.

It is thus the essence of the invention to provide improvements in both process and apparatus employed in feeding liquid alloyed metal into a continuous casting machine.

We claim:

1. In a process for casting an alloyed metal such as calcium lead into a continuous strip for producing an end product such as battery grids and the like, said process casting a continuous strip of alloyed metal at a rate of at least 8 tons per hour by means of a casting machine and employing a tundish for feeding liquid alloyed metal into said caster and a holding box for metering at a constant rate liquid alloyed metal into said tundish, the improvement comprising the steps of:

charging, at predetermined intervals, metal and alloy hogs into a melting pot having a minimum liquid bath level therein by sliding said hogs down an inclined yieldable ramp, said ramp being submersed over a central portion thereof in said minimum bath level of said melting pot;

heating said bath level to a constant temperature of approximately 700° F. by electrical heating elements disposed within conventional protection tubes submersed entirely within said minimum bath level;

melting said hogs at said central portion of said ramp whereby said hogs are maintained at a constant elevation with respect to said minimum bath level;

maintaining a protective atmosphere substantially devoid of oxygen within said melting pot;

pumping said liquid metal from said melting pot to a holding pot through a closed conduit;

heating at a constant temperature said liquid metal in said holding pot by heating elements disposed within conventional pipes completely submersed within a minimum liquid metal bath level in said holding pot while maintaining a protective atmosphere withing said holding pot;

controlling the liquid levels in said melting and holding pots in dependent relationship with respect to one another by a float in each pot in contact with said bath level in each pot whereby said holding pot is effectively operated as a surge tank; and pumping a portion of said liquid metal from said holding pot to said holding box through a closed conduit.

* * * * *